US006009298A

United States Patent [19]

Sakamaki et al.

[11] Patent Number: 6,009,298

[45] Date of Patent: Dec. 28, 1999

[54] IMAGE TRANSFER APPARATUS AND IMAGE FORMING APPARATUS

[75] Inventors: Katsumi Sakamaki; Koichiro Okamura, both of Nakai-machi, Japan

[73] Assignee: Fuji Xerox Co., Ltd., Tokyo, Japan

[21] Appl. No.: 09/129,608

[22] Filed: Aug. 5, 1998

[30] Foreign Application Priority Data

Aug. 8, 1997 [JP] Japan ..... 9-215021

[51] Int. Cl.[6] ..... G03G 15/16

[52] U.S. Cl. ..... 399/318; 399/308

[58] Field of Search ..... 399/297, 302, 399/308, 307, 313, 317, 318, 66

[56] References Cited

U.S. PATENT DOCUMENTS

| | | | |
|---|---|---|---|
| 5,040,028 | 8/1991 | Kamimura et al. | 399/302 |
| 5,099,286 | 3/1992 | Nishise et al. | 399/302 |
| 5,291,252 | 3/1994 | Kawaishi | 399/308 X |
| 5,374,982 | 12/1994 | Boockkholdt | 399/318 |
| 5,561,510 | 10/1996 | Kamp et al. | 399/308 |
| 5,565,975 | 10/1996 | Kumon et al. | 399/302 |
| 5,572,305 | 11/1996 | Hayashi et al. | 399/313 X |
| 5,640,659 | 6/1997 | Thompson et al. | 399/307 |
| 5,729,788 | 3/1998 | Hirohashi et al. | 399/66 |
| 5,742,888 | 4/1998 | Fuchiwaki et al. | 399/308 |
| 5,752,130 | 5/1998 | Tanaka et al. | 399/308 X |

FOREIGN PATENT DOCUMENTS

| | | |
|---|---|---|
| 6-27832 | 2/1994 | Japan . |
| 6-317994 | 11/1994 | Japan . |

*Primary Examiner*—Sandra Brase
*Attorney, Agent, or Firm*—Oliff & Berridge, PLC

[57] ABSTRACT

There are provided an image transfer apparatus and an image forming apparatus which can form an image of excellent quality by controlling speed variations of an image carrier and an intermediate transfer body generated by an external force. When the front end of a recording medium enters the nip area provided between the intermediate transfer body and a bias transfer roll and the rear end of the recording medium leaves the nip area, an impact force is applied to the intermediate transfer body and the bias transfer roll. The bias transfer roll swings, due to such impact force, in the direction parallel to the traveling direction of the recording medium to enter the nip area. As a result, a transitional load variation to be applied to the intermediate transfer body with such impact force is absorbed by springs to prevent rotating variation of the intermediate transfer body and the image carrier.

34 Claims, 11 Drawing Sheets

IMAGE TRANSFER APPARATUS AND IMAGE FORMING APPARATUS

BACKGROUND OF THE INVENTION

1. Field of the Invention

The present invention relates to an image transfer apparatus utilizing an image carrier such as a dielectric material drum, photosensitive material drum and photosensitive material belt, etc. or an image transfer member for transferring a visible image on an intermediate transfer body to a recording medium or a simultaneously transferring and fixing member, an electrophotographic copying apparatus for obtaining an image with one or a plurality of image forming means and an image forming apparatus such as electrophotographic printer, ionographic printer, ink jet printer and facsimile apparatus, etc. and particularly to a transfer apparatus and image forming apparatus which controls speed variation of an image carrier and intermediate transfer body.

2. Description of the Related Art

As a transfer apparatus of related art, for example, an apparatus utilizing a bias transfer roll is popular. In this transfer apparatus, a bias transfer roll is pressed toward to a photosensitive drum, on which a toner image is formed while it is rotating at the predetermined speed, at the predetermined contact pressure with a spring and a toner image on the photosensitive drum is transferred to a recording paper while the paper passes the transfer section (nip section) formed between the photosensitive drum and bias transfer roll. According to this transfer apparatus, the recording paper itself is charged in a small extent, unlike the corona transfer method, and therefore the recording paper can be separated easily from the photosensitive drum and excellent transfer image can be obtained without generation of any irregular image due to the separation discharge at the time of separation of paper.

Moreover, an image forming apparatus of the related art is described, for example, in the Japanese Published Unexamined Patent Application No. Hei 6-27832 and Japanese Published Unexamined Patent Application No. Hei 6-317994.

The image forming apparatus proposed in the Japanese Published Unexamined Patent Application Hei 6-27832 comprises a photosensitive drum for carrying a toner image, an intermediate transfer and fixing belt extended over a heat roll, a drive roll and a transfer roll and a spring which energizes the transfer roll in the direction to be isolated from the photosensitive drum. In this structure, when the drive roll is driven to rotate, the transfer roll is displaced with a tension of the intermediate transferring and fixing belt, causing the intermediate transferring and fixing belt to be brought in pressure contact with the photosensitive drum. Thereby, while the copying operation is stopped, the intermediate transferring and fixing belt is isolated from the photosensitive drum to prevent the toner on the photosensitive drum to be adhered to the intermediate transferring and fixing belt to contaminate it.

The image forming apparatus proposed in the Japanese Published Unexamined Patent Application No. Hei 6-317994 is provided with a resist sensor for detecting front end and rear end of the recording paper and a cam for causing the transfer roll to be in contact with or separated from the image carrier without giving any impact thereto depending on detection by resist sensor. In this structure, when the resist sensor detects the front end of the recording paper, the transfer roll is brought in pressure contact with the image carrier due to rotation of the cam to transfer the toner image on the image carrier to the recording paper until the front end of the recording paper reaches the transfer area between the image carrier and transfer roll. When image transfer progresses and the resist sensor detects the rear end of the recording paper, the transfer roll is isolated from the image carrier due to rotation of the cam when the rear end of paper passes the transfer area. Thereby, since the transfer roll is isolated from the image carrier when the recording paper does not exist, the toner remaining on the image carrier is transferred to the transfer roll to prevent contamination of back surface of the subsequent recording paper. Moreover, when the transfer roll is placed in contact with the image carrier, no impact is given owing to the cam and thereby disturbance of image to be written to the image carrier can be prevented.

However, according to the transfer apparatus of the related art, when the recording paper passes the area between the photosensitive drum and transfer roll, particularly when the front end of paper enters the nip section between the photosensitive drum and transfer roll and the rear end of paper leaves the nip section, an impact is given to the photosensitive drum and transfer roll due to a level difference resulting from thickness of recording paper and thereby a load torque of the photosensitive drum varies, resulting in a problem that a rotating speed of the photosensitive drum varies. Particularly, this problem is serious for running of a thick recording paper.

Moreover, in the structure that distance between the transfer process position and fixing process position is shorter than the length of recording paper and thereby the paper is carried by both processes, the paper speed in the fixing process is generally a little lower than the paper speed in the transfer process to generate a certain looseness in order to absorb an error of speed in both processes. However, in this case, the recording paper is further carried and a loop of the paper grows, allowing an internal stress accumulated in the paper to increase. As a result, a stress of the paper gives a resistance force in the rotating direction of the photosensitive drum and transfer roll. Therefore, when the rear end of the paper is released from the transfer roll, such resistance force is also released, resulting in a large variation of rotation. This problem also exists in the monochromatic printer and it is a serious problem of image quality such as displacement of color and uneven color tone in the full-color printer.

Moreover, according to an image forming apparatus of the related art described in the Japanese Published Unexamined Patent Application No. Hei 6-27832, the intermediate transferring and fixing belt is selectively used for transfer operation to the photosensitive drum and other operations, and transitional impact has never been alleviated when the recording paper enters the nip section or leaves the nip section. Therefore, the paper gives a transitional impact to the nip section it passes therein to give transitional speed variation to the image carrier, resulting in a defect in the image quality such as displacement of color and uneven color tone.

Moreover, according to the image forming apparatus described in the Japanese Published Unexamined Patent Application No. Hei 6-317994, certain consideration is taken into account in order to eliminate an impact generated when the transfer roll is placed in contact with the photosensitive drum, but the transitional impact generated when the recording paper passes through the nip section is not alleviated, similarly resulting in a defect in image quality such as displacement of color and uneven color tone.

OBJECTS AND SUMMARY OF THE INVENTION

It is therefore an object of the present invention to provide a transfer apparatus and an image forming apparatus which can control speed variation of an image carrier and an intermediate transfer body generated by an external force and assures formation of the excellent image.

In view of attaining the object explained above, the present invention provides a transfer apparatus comprising an image carrier allowing formation of a visible image on the surface thereof while it is rotating at the predetermined speed and a transfer material brought in pressure contact with an image forming medium such as an intermediate transfer body at the predetermined contact pressure to transfer the visible image on the image forming medium to a recording medium traveling to the transfer area between the transfer member and image forming medium, further comprising a movable means for supporting the transfer member to swing in the predetermined direction and causing the transfer member to swing in the predetermined direction depending on an external force generated depending on traveling of the recording medium to the transfer area.

In view of attaining the object explained above, the present invention provides a transfer apparatus comprising an intermediate transfer body which is placed in contact, at the predetermined contact pressure, with an image carrier carrying a visible image at the surface thereof while it is rotating at the predetermined speed, a transfer member in contact with the intermediate transfer body and a contact member such as a cleaning member, etc. to transfer the visible image on the image carrier to the intermediate transfer body, further comprising movable means for supporting the intermediate transfer body to swing in the predetermined direction and causing the intermediate transfer body to swing in the predetermined direction depending on an external force generated on the basis of contact of the contact member with the intermediate transfer body.

In view of attaining the object explained above, in the present invention, movable means are provided which comprise an image carrier to form a visible image on the surface thereof while it is rotating at the predetermined speed, an image forming medium such as an intermediate transfer body and a transfer member which is brought in pressure contact with the image forming medium at the predetermined contact pressure to transfer the visible image on the image forming medium to the recording medium traveling to the transfer area provided between the image forming medium and transfer member to support the transfer member to swing in the predetermined direction and cause the transfer member to swing in the predetermined direction depending on an external force generated while the recording medium travels to the transfer area.

In view of attaining the object described above, in the present invention, movable means are provided which comprise an image carrier for carrying a visible image on the surface thereof while it is rotating at the predetermined speed, an intermediate transfer body which is placed in contact with the image carrier at the predetermined contact pressure, a transfer member in contact with the intermediate transfer body and a contact member such as a cleaning member to support the intermediate transfer body to swing in the predetermined direction and causes the intermediate transfer body to swing in the predetermined direction depending on an external force generated when the intermediate transfer body, is in contact with the contact member.

BRIEF DESCRIPTION OF THE DRAWINGS

Other objects and advantages of the present invention will be apparent from the following detailed description of the presently preferred embodiments thereof, which description should be considered in conjunction with the accompanying drawings in which:

FIG. 3 (*b*) is a waveform diagram showing speed variation rate of the intermediate transfer body in the related art;

DESCRIPTION OF THE PREFERRED EMBODIMENTS

Figure 1:
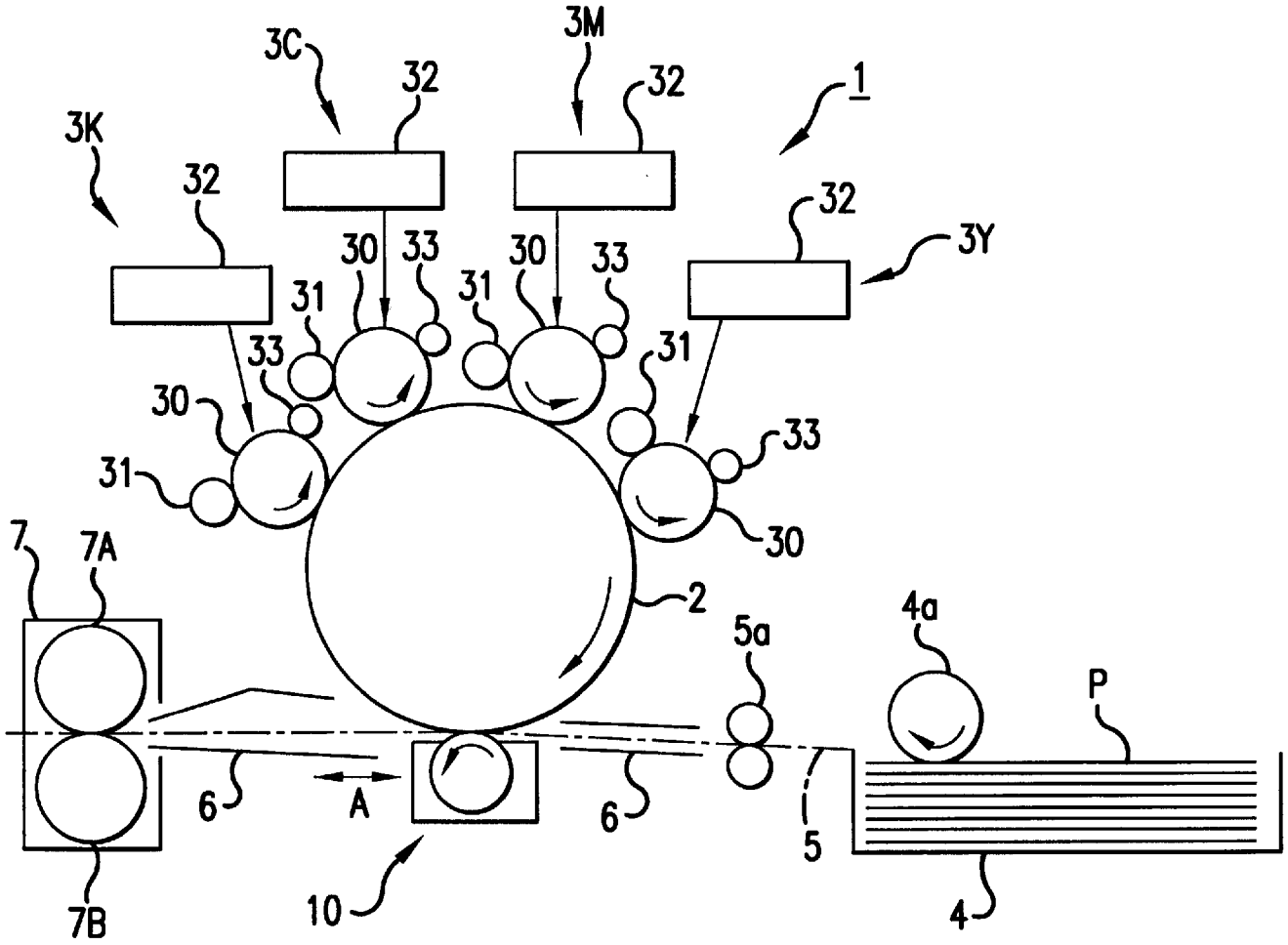
FIG. 1 is a schematic structural diagram of a copying machine in relation to the first embodiment of the present invention.

FIG. 1 shows a color copying machine to which an image forming apparatus in relation to the first embodiment of the present invention is applied. This color copying machine 1 is provided with a drum type intermediate transfer body 2 to rotate in the direction indicated by the arrow mark, image forming units 3K, 3C, 3M, 3Y to form toner images of Black (K), Cyan (C), Magenta (M) and Yellow (Y) to the intermediate transfer body 2, a paper feed cassette 4 accommodating the recording paper P, a paper feed roll 4*a* for feeding the paper P to the transfer route 5 from the paper feed cassette 4, a transfer roll 5*a* to transfer the paper P along the transfer route 5, a paper guide plate 6 arranged along the transfer route 5, a transfer unit 10 to transfer the color toner image transferred to the intermediate transfer body 2 to the paper P by means of the bias transfer roll 11, and a fixing unit 7 consisting of a pair of fixing rolls 7A, 7B for fixing the color toner image transferred to the paper P.

The image forming units 3K, 3C, 3M, 3Y are respectively provided with a drum type photosensitive material 30 to rotate in the direction indicated by the arrow mark, a charger 31 to uniformly charge the surface of photosensitive material 30, an exposing unit 32 to form an electrostatic latent image by exposing the surface of the uniformly charged photosensitive material 30 with a laser beam modulated by image signals of K, C, M, Y from an image processing section not illustrated, and a developing unit 33 to obtain a visible toner image by respectively developing the electrostatic latent image formed on the surface of the photosensitive material 30 with the toner of K, C, M, Y and further provided, although not illustrated, with a transfer unit for transferring the visible toner image to the intermediate transfer body 2, a discharger for discharging the photosensitive material 30, a cleaning unit for removing remaining toner on the surface of photosensitive material 30, and an erasing lamp for re-discharging the surface of the photosensitive material 30.

Figure 2:
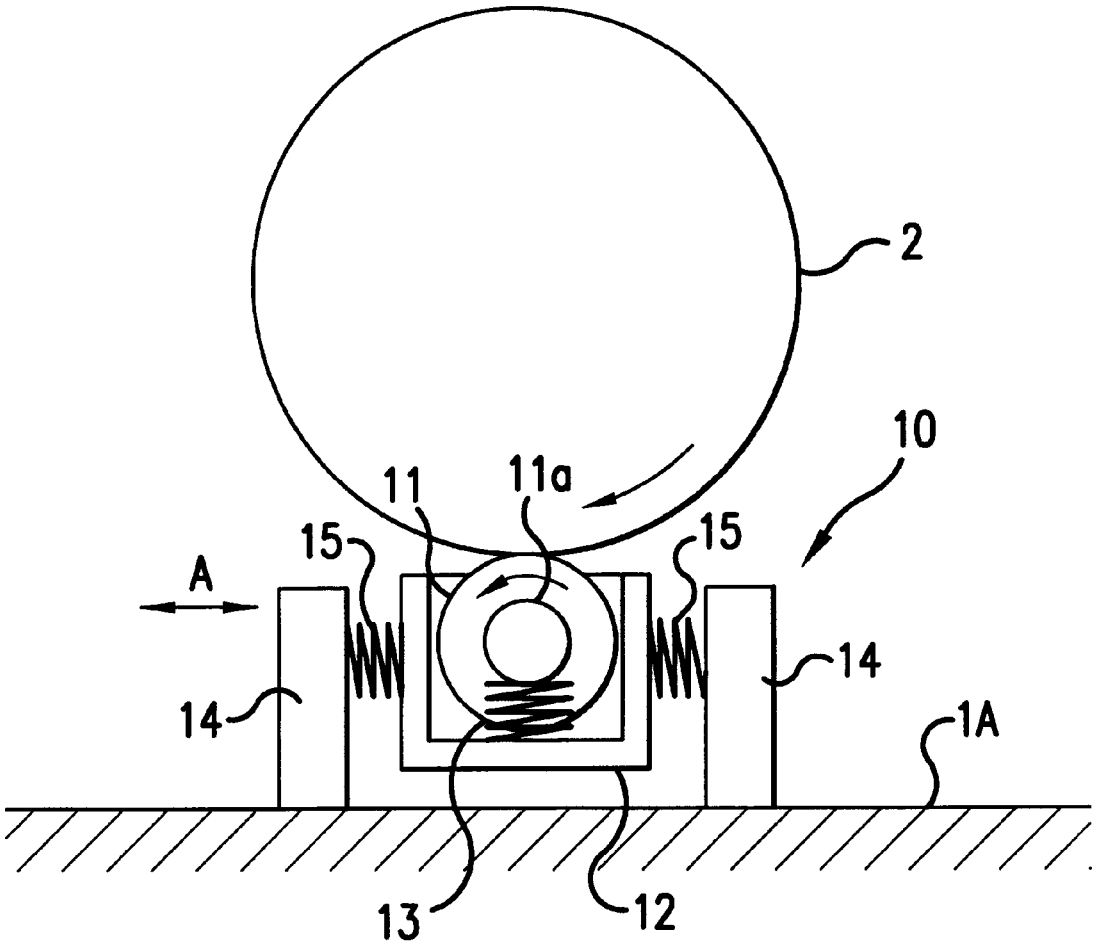
FIG. 2 is a structural diagram of a transfer unit in relation to the first embodiment.

FIG. 2 shows a transfer unit 10. This transfer unit 10 is provided with a bias transfer roll 11 to be in contact with a drum type intermediate transfer body 2, a supporting body 12 for accommodating the bias transfer roll 11 to be exposed in the upper side and supporting a shaft 11*a* projected from both sides of the bias transfer roll 11 to move in the upper and lower direction, a spring 13 provided to the supporting body 12 to pressurize in contact the bias transfer roll 11 with the intermediate transfer body 2 in the predetermined load by pushing upward the shaft 11*a*, a pair of fixing members 14, 14 formed on the body of copying machine 1A by providing therebetween the predetermined distance, a pair of springs 15, 15 for supporting the supporting body 12 from both sides to swing in the direction almost parallel (tangent direction) to the traveling direction of the paper P, and a restricting member, not illustrated, to restrict movement of the supporting body 12 in the upper and lower direction perpendicular to the tangent direction A.

This transfer unit 10 will further be explained. It is assumed here that the paper P being held by the transfer area (nip section) between the intermediate transfer body 2 and bias transfer roll 11 is leaving the nip section. When the paper P leaves the nip section, the bias transfer roll 11 moves downward by compressing the spring or the roll 11 itself has been elastically deformed in the related art. However, since this is realized as the change in the vertical direction to the traveling direction of the paper P, at the moment that the paper P has left the nip section, the roll 11 gives a change of load to rotation of the intermediate transfer body 2 by trying to return to the initial condition resulting in impact. Moreover, in the paper P, an internal stress is accumulated in the flexure growing against the fixing unit 7 and the internal stress becomes 0 at the moment that the paper P has left the nip section. Accordingly, a rotating load of the intermediate transfer body 2 changes rapidly. Meanwhile, in the transfer unit 10 of this copying machine 1, the bias transfer roll 11 moves elastically in the direction A which is almost parallel to the traveling direction of the paper P by receiving a reactive force of the paper P a little before the paper P leaves the nip section, not accumulating rotation resistance to the intermediate transfer body 2.

Next, operation of this copying machine 1 will be explained. The intermediate transfer body 2 sequentially receives transfer of toner image of each color of K, C, M, Y respectively from the image forming units 3K, 3C, 3M, 3Y to form a color toner image on the intermediate transfer body 2. The paper P is fed by a paper feed roll 4*a* from the paper feed cassette 4 and is the sequentially transferred to the nip section between the intermediate transfer body 2 and transfer unit 10. When the paper P has passed the nip section, the color toner images on the intermediate transfer body 2 are Transferred at a time to the paper P. Thereafter, this color toner images are then transferred to the fixing unit 7 and the toner images of respective colors are then fused on the paper P by the fixing unit 7 and a color image is fixed. Meanwhile, the surface of the photosensitive material 30 having completed the transfer of toner image is discharged by a discharger not illustrated and the remaining toner is removed by a cleaning unit. Thereafter, the surface is discharged again by an erase lamp for the formation of the next image. Moreover, when the front end of the paper P enters the nip area between the intermediate transfer body 2 and transfer unit 10, an impact force is applied to the nip section when the rear end of the paper P is leaving the nip section, and the supporting body 12 swings in the tangent direction A with such impact force. As a result, a transitional load variation to be applied to the intermediate transfer body 2 with the impact force is absorbed by the springs 15, 15 to prevent fluctuation of rotation of the intermediate transfer body 2.

Figure 3A:
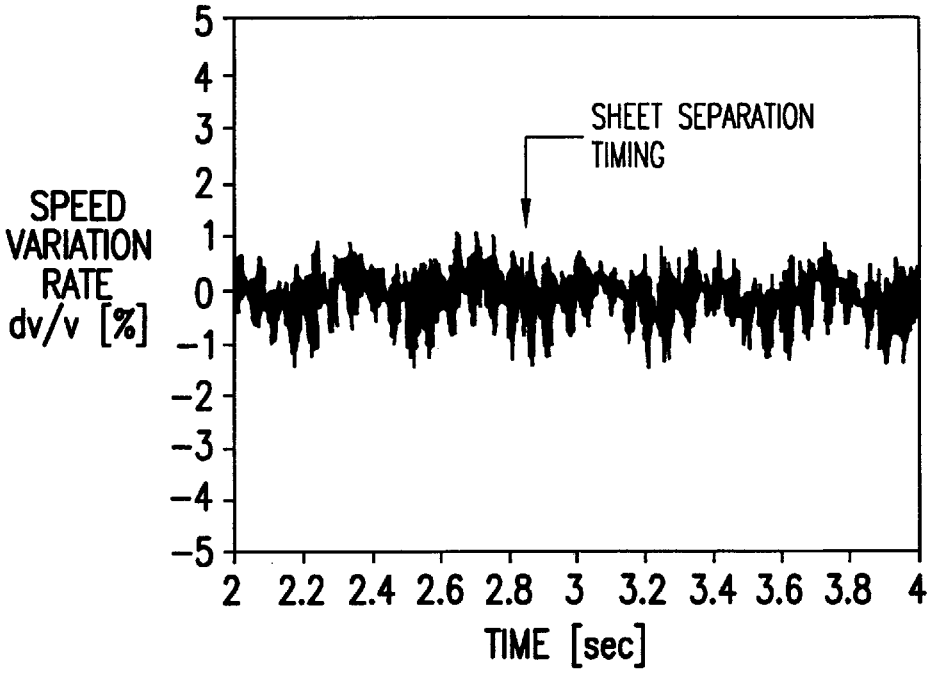
FIG. 3(*a*) is a waveform diagram showing speed variation rate of the intermediate transfer body in the first embodiment.
Figure 3B:
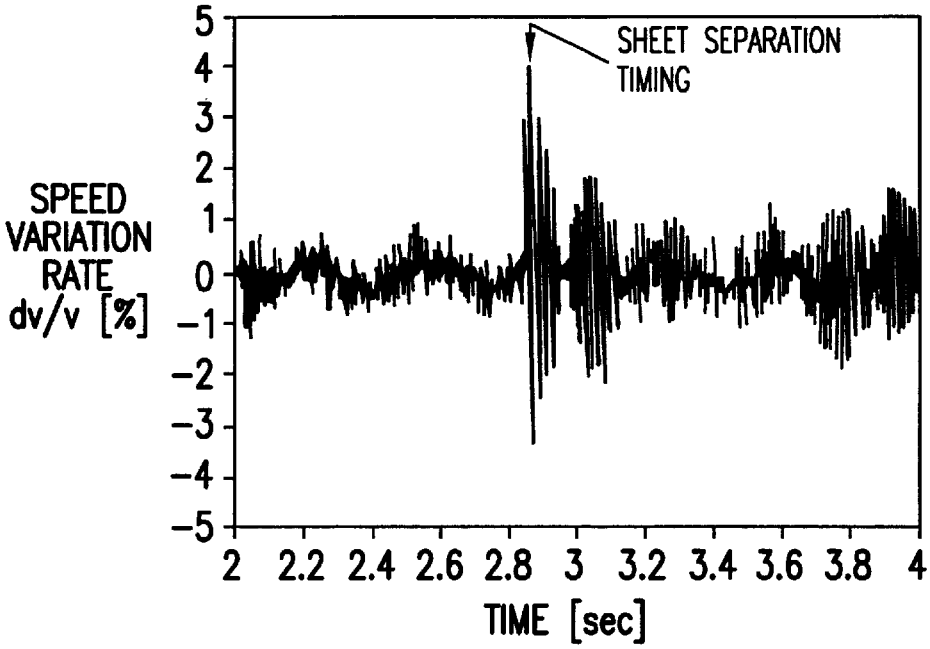

FIG. 3 shows a speed variation rate of the intermediate transfer body 2. FIG. 3(*a*) shows a result of measurement for a speed variation rate of the shaft of the intermediate transfer body 2 in the structure of the transfer bit 10 shown in FIG. 2 when the fixing unit 7 is installed at the position separated by 100 mm in the lower stream side from the nip section between the intermediate transfer body 2 and the bias transfer roll 11, an ordinary paper (about 80 g/m$^2$) is fed in the vertical direction in the process speed of 130 mm/sec as the paper P of size A4, the transfer speed of the fixing rolls 7A, 7B is lowered by a bout 1% and flexure is formed on the paper P after the fixing rolls 7A, 7B catch the paper P. The above setting is an ordinary setting. Moreover, FIG. 3(*b*) shows a result of measurement for the speed variation rate of the shaft of intermediate transfer body 2 in the structure of the related art that the bias transfer roll 11 does not swing in the tangent direction A.

Table 1 shows the result of measurement in FIG. 3 and the result of measurement conducted in the same manner as FIG. 3 for a thick paper P (220 g/m$^2$).

TABLE 1

| | Transfer method | |
|---|---|---|
| Paper conditions | Present invention (Swing in the traveling direction of transfer roll) | Related Art (Fixed in the traveling direction of transfer roll) |
| Ordinary paper (about 80 g/m$^2$) | 2.3% peak–peak | 7.4% peak–peak |
| Thick paper (220 g/m$^2$) | 2.95% peak–peak | 4.0% peak–peak |

Next, the effect of the first embodiment will be explained.

(a) Since the bias transfer roll 11 is supported to rotate in the direction A parallel to the traveling direction of the paper P, a transitional load change generated when the front end of the paper P enters the nip section and the rear end of the paper P leaves the nip section is absorbed by swinging of the bias transfer roll 11 to prevent fluctuation of rotation of the intermediate transfer body 2. As a result, rotating fluctuation of the photosensitive material 30 in contact with the intermediate transfer body 2 can be prevented to avoid occurrence of a defect in the image formed on the photosensitive material 30. It can be proved, as is apparent from Table 1, by that the speed variation rate of the intermediate transfer body 2 when the paper P leaves the nip section can be reduced remarkably both in the ordinary paper and thick paper. Moreover, as is obvious from FIG. 3, ordinary vibration can also be reduced by the structure of this embodiment.

(b) Since the bias transfer roll 11 is elastically brought in pressure contact with the intermediate transfer body 2 with the spring 13, its transfer function realizes good transfer operation and prevents rotating fluctuation of the intermediate transfer body 2 and photosensitive material 30.

(c) Since the bias transfer roll 11 is used as a transfer member, even in the system where the photosensitive material 30 and transfer member are brought in pressure contact to nip the paper P, an adverse effect is never given to the photosensitive material 30 or intermediate transfer body 2, unlike the corona transfer.

Figure 4:
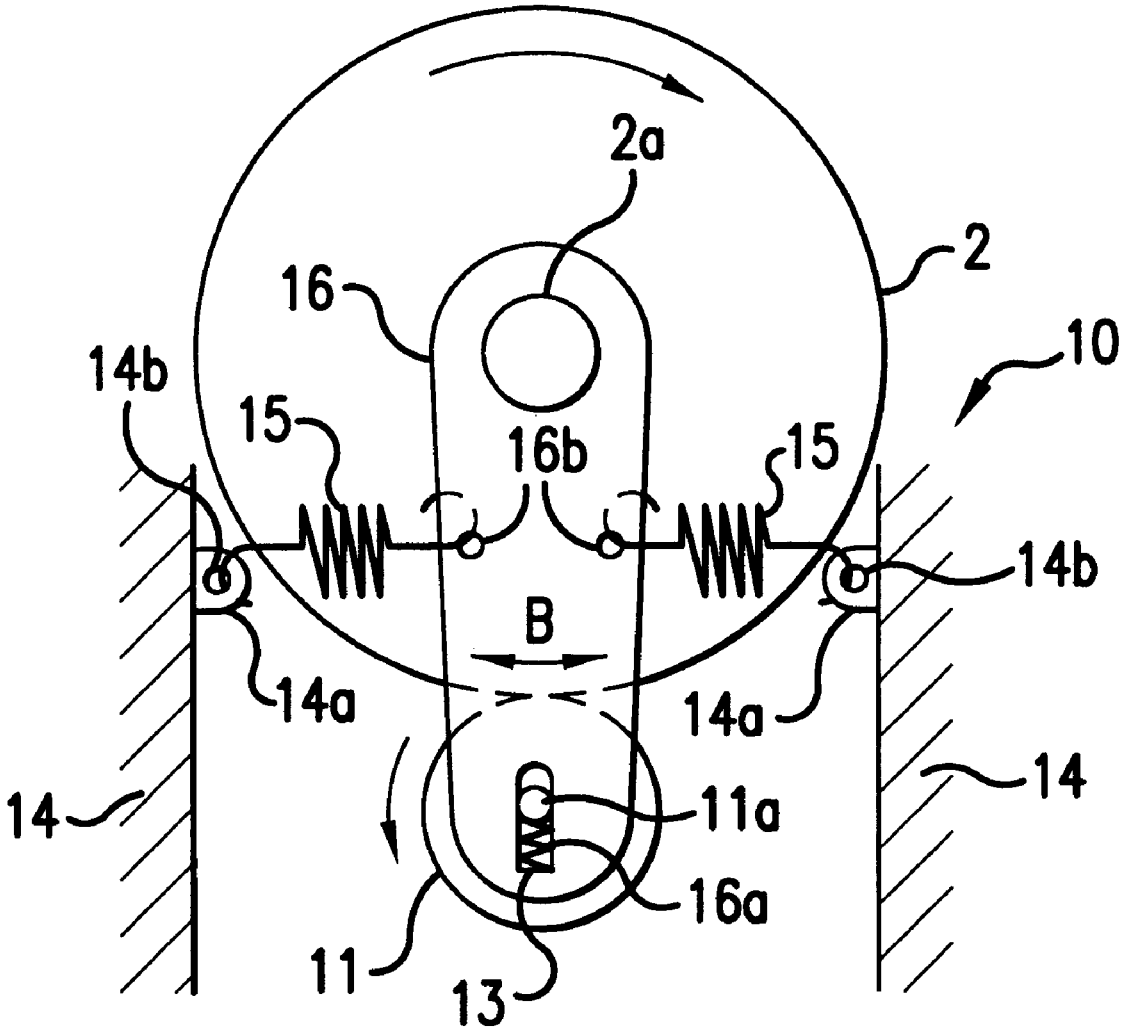
FIG. 4 is a structural diagram of a transfer unit in relation to the second embodiment of the present invention.

FIG. 4 shows a transfer unit 10 in relation to the second embodiment of the present invention. This transfer unit 10 has a structure that the bias transfer roll 11 can swing in the arc direction B around the rotating shaft 2*a* of the intermediate transfer body 2. Namely, this transfer unit 10 is provided with a supporting arm 16 of which the base end side is fitted rotatably to a rotating shaft 2*a* of the intermediate transfer body 2, a couple of fixing members 14, 14 formed on the copying machine body 1A keeping the predetermined distance therebetween, and a couple of springs 15, 15 for supporting the supporting arm 16 from both sides to swing around the rotating shaft 2*a* of the intermediate transfer body 2. At the front end side of the supporting arm 16, an elongated hole 16*a* is formed to support the shaft 11*a* of the bias transfer roll 11 to rotate and move in the vertical direction. In this elongated hole 16*a*, a spring 13 is arranged to pressurize the bias transfer roll 11 in contact with the intermediate transfer body 2 with the predetermined load by moving upward the shaft 11*a*. The spring 15 engages, at its one end, with the engaging hole 14*b* formed at the projected portion 14*a* of the fixing member 14 and also engages, at the other end, with the engaging hole 16*b* formed to the supporting arm 16.

According to the second embodiment, the same effect as that of the first embodiment can be obtained because the bias transfer roll 11 can swing in the direction of arc B around the rotating shaft 2*a* of the intermediate transfer body 2.

Figure 5:
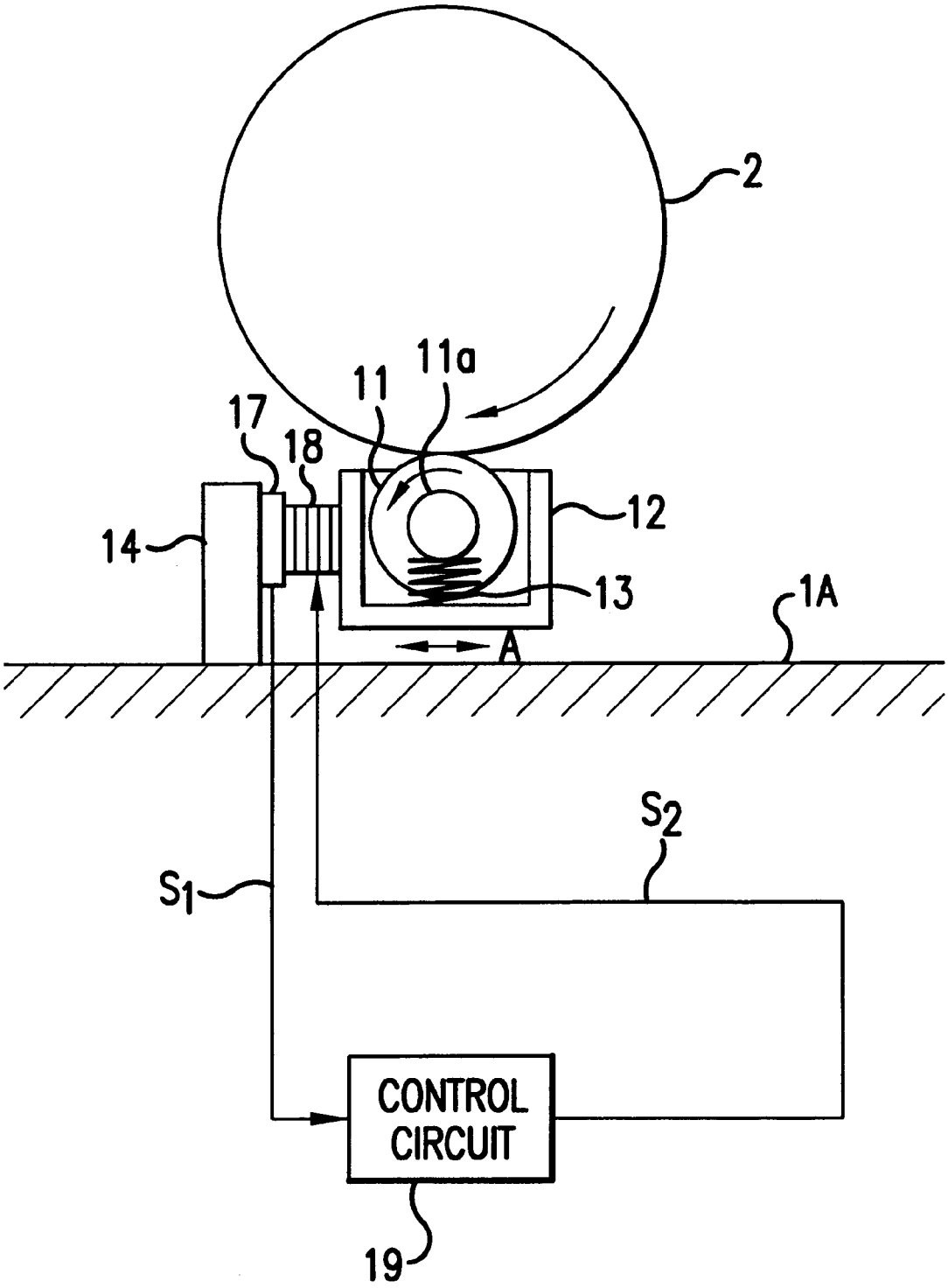
FIG. 5 is a structural diagram of a transfer unit in relation to the third embodiment of the present invention.

FIG. 5 shows a transfer unit in relation to the third embodiment of the present invention. This transfer unit 10 has a structure that the bias transfer roll 11 can swing in the tangent direction A. Namely, this transfer unit 10 is provided with a bias transfer roll 11 which is in contact with the drum type intermediate transfer body 2, a supporting means 12 for accommodating the bias transfer roll 11 to be exposed in the upper side to support the shaft 11*a* projected from both sides of the bias transfer roll 11 to rotate in the upper and lower direction, a spring 13 provided to the supporting body 12 to pressurize the bias transfer roll 11 in contact with the intermediate transfer body 2 in the predetermined load by pushing upward the shaft 11*a*, an external force detecting means 17 for detecting an external force in the tangent direction A applied on the bias transfer roll 11, a displacing means 18 for displacing the bias transfer roll 11 in the tangent direction A, and a control circuit 19 for outputting a control signal $S_2$ to the displacing means 18 to displace the bias transfer roll 11 in the direction to reduce the external force in the tangent direction A applied to the bias transfer roll 11 depending on the detecting signal SI of the external force detecting means 17.

As the external force detecting means 17, a strain gauge and a piezoelectric element, etc. can be used. Moreover, as the displacing means 18, a piezoelectric element and a voice coil type actuator can be used. The control circuit 19 calculates displacement of the bias transfer roll 11 to minimize the speed variation rate of the intermediate transfer body 2 depending on the detecting signal $S_1$ of the external force detecting means 17 to execute the feedback control to send the control signal $S_2$ to the displacing means 18 to displace the bias transfer roll 11 as much as the calculated displacement.

Thereby, even when an impact force when the paper P enters the nip area and leaves the nip area is applied to the bias transfer roll 11, the speed variation rate of the intermediate transfer body 2 can be lowered by the swinging movement of the bias transfer roll 11 under the control of the control circuit 19.

According to the third embodiment, since the bias transfer roll 11 displaces in the direction to reduce an external force applied on the external force detecting means 17, the external force is absorbed by the displacement proportional to an external force corresponding to the amount of load variation. Therefore, rotating fluctuation of the intermediate transfer body 2 and photosensitive material 30 can be prevented.

Figure 6:
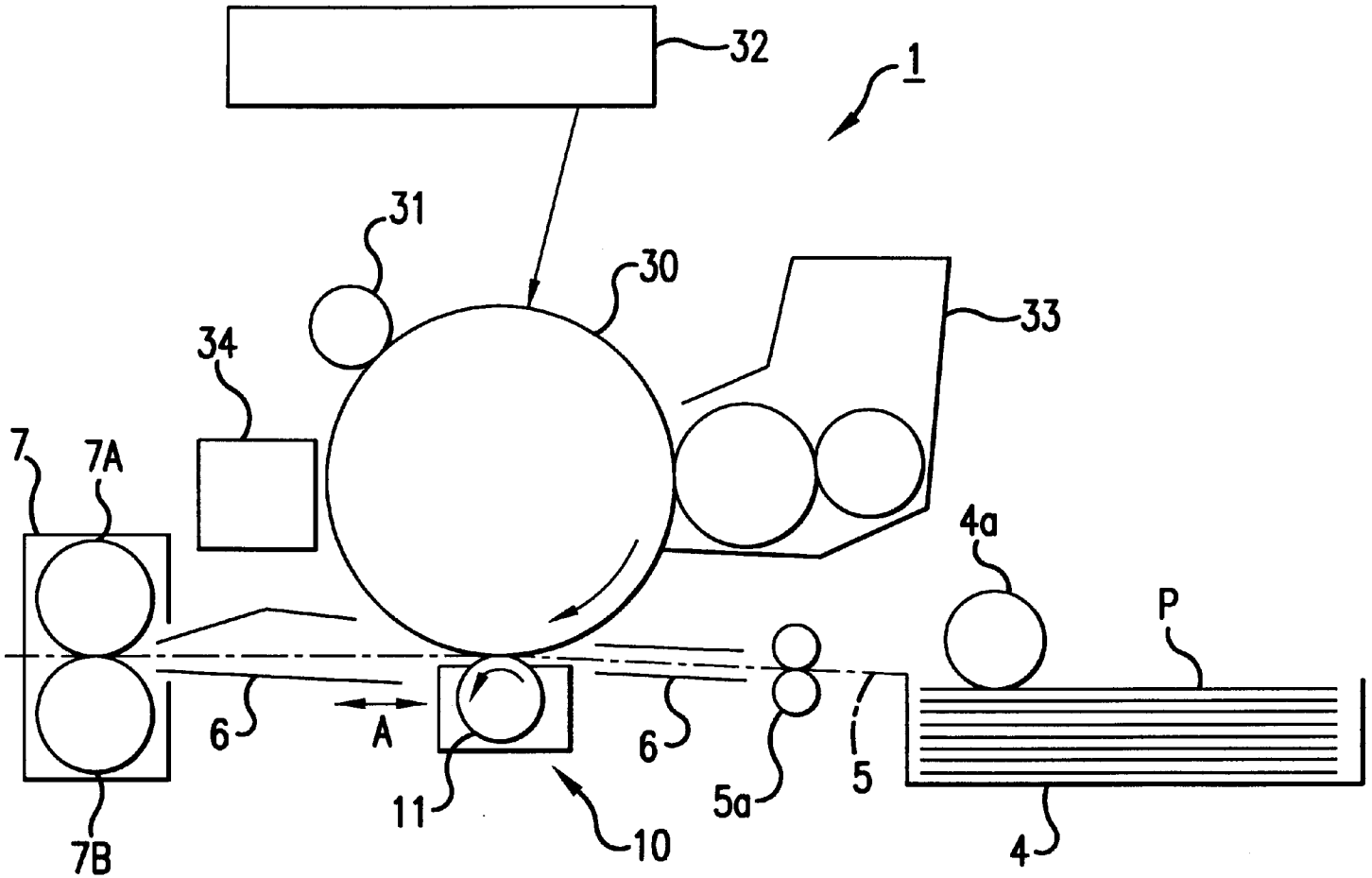
FIG. 6 is a schematic structural diagram of a copying machine in relation to the fourth embodiment of the present invention.

FIG. 6 shows a monochromatic copying machine to which the image forming apparatus in relation to the fourth embodiment of the present invention is applied. This copying machine 1 comprises a drum type photosensitive material 30 to rotate in the direction indicated by the arrow mark, a charger 31 for uniformly charging the surface of the photosensitive material 30, an exposing unit 32 to form an electrostatic latent image by exposing the surface of the uniformly charged photosensitive material 30 with a laser beam modulated by the image signal from the image processing section not illustrated, a developing unit 33 to obtain a visible toner image by developing, with the black toner, the electrostatic latent image formed on the surface of the photosensitive material 30, a cleaning unit 34 to eliminate the remaining toner, etc. on the surface of photosensitive material 30, a paper feed cassette 4 accommodating the paper P, a paper feed roll 4*a* for feeding the paper P to the transfer route 5 from the paper feed cassette 4, a transfer roll 5*a* to transfer the paper P along the transfer route 5, a paper guide plate 6 arranged along the transfer route 5, a transfer unit 10 to transfer the visible toner image formed on the photosensitive material 30 to the paper P by means of the bias transfer roll 11, and a fixing unit 7 consisting of a couple of fixing rolls 7A, 7B to fix the visible toner image transferred to the paper P. As the transfer unit 10, the structures of the profile of the first embodiment shown in FIG. 2, the profile of the second embodiment shown in FIG. 4, and the profile of the third embodiment shown in FIG. 5 can be applied.

Figure 7:
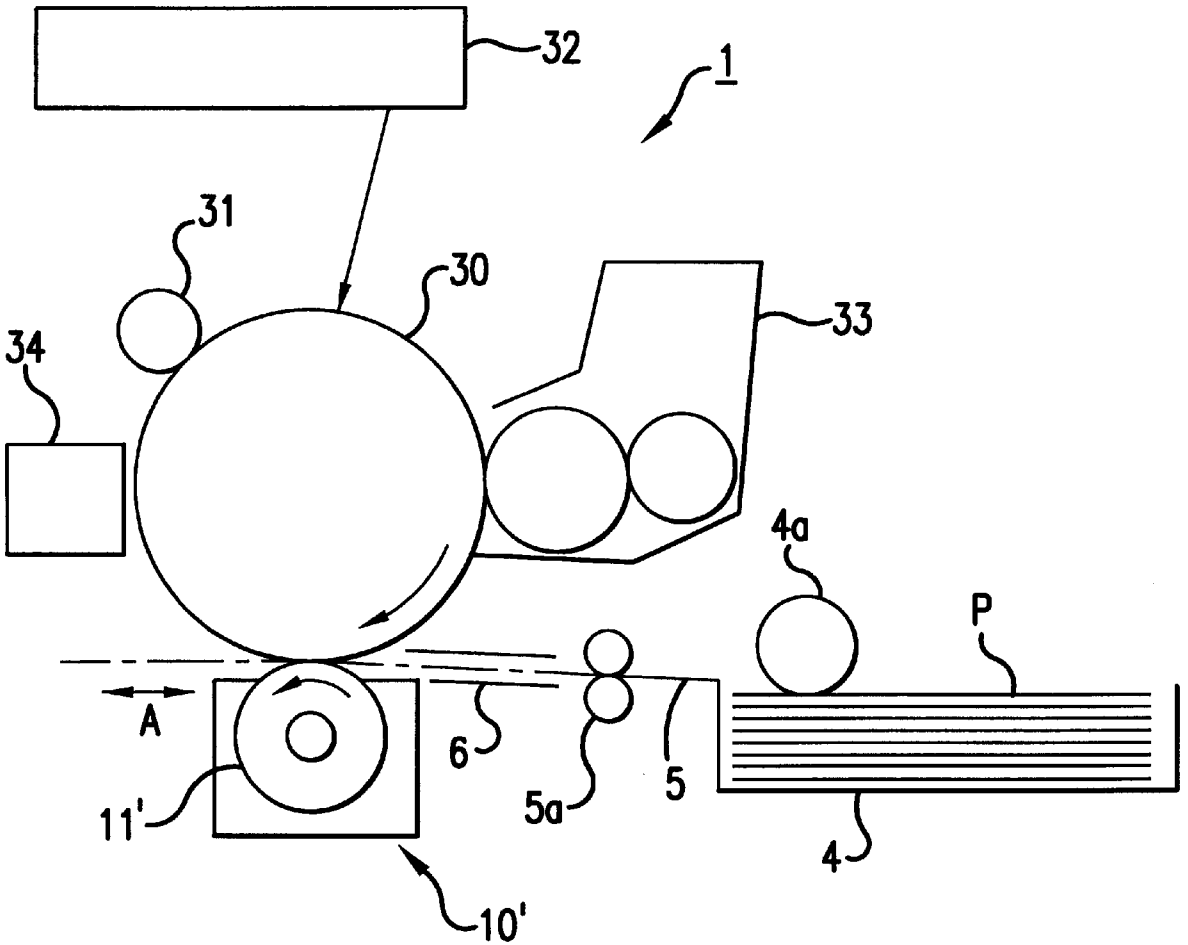
FIG. 7 is a schematic structural diagram of a copying machine in relation to the fifth embodiment of the present invention.

FIG. 7 shows a copying machine to which the image forming apparatus in relation to the fifth embodiment of the present invention is applied. This copying machine 1 introduces the fixing unit 7 and transfer unit 10 of the copying machine 1 in relation to the fourth embodiment shown in FIG. 6 as a transferring and fixing unit 10' which simultaneously executes the transfer and fixing of image and the other portions are formed in the same structure as the fourth embodiment. The transferring and fixing unit 10' is provided with the transferring and fixing roll 11' which is brought in pressure contact with the photosensitive material 30 at the predetermined pressure. This transferring and fixing roll 11' is structured to swing in the direction A almost parallel to the traveling direction of the paper P depending on the transitional impact generated when the paper P enters and leaves the nip area like the profile of the first embodiment shown in FIG. 2, the profile of the second embodiment shown in FIG. 4, and the profile of the third embodiment shown in FIG. 5.

According to the profile of the fifth embodiment, in the case of the simultaneous transferring and fixing system, since the transferring and fixing roll 11' is brought in pressure contact with the photosensitive material 3C at a high pressure in order to improve the fixing efficiency, a large transitional impact has been generated in the related art. However, application of the structure of this embodiment can reduce the speed variation rate of the photosensitive material 30 due to such impact.

Figure 8:
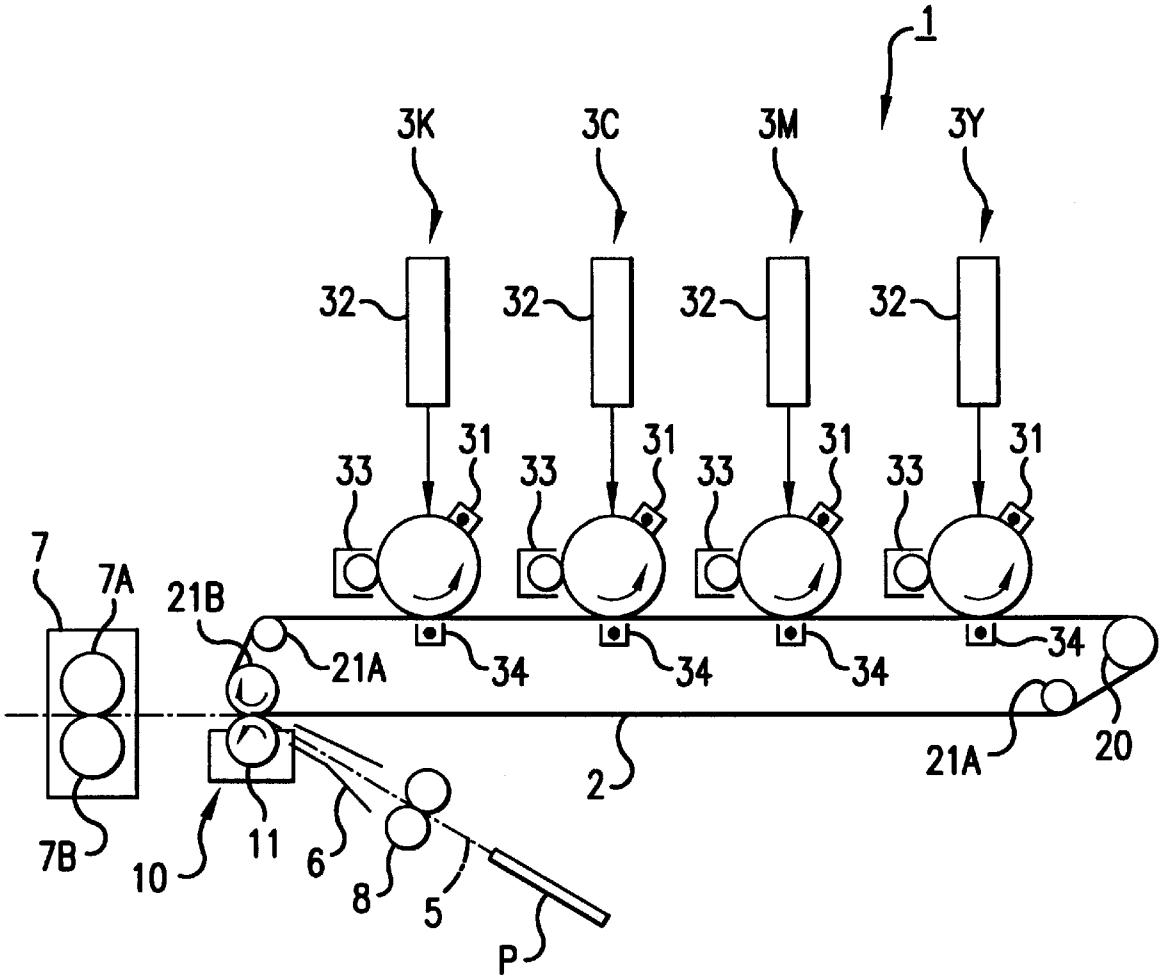
FIG. 8 is a schematic structural diagram of a copying machine in relation to the sixth embodiment of the present invention.

FIG. 8 shows a full-color copying machine to which the image forming apparatus in relation to the sixth embodiment of the present invention is applied. This copying machine 1 is a tandem type machine utilizing a belt tape intermediate transfer body 2, comprising a belt type intermediate transfer body 2 extended over the drive roll 20 and driven rolls 21A, 21B, image forming units 3K, 3C, 3M, 3Y structured like the first embodiment provided along the intermediate transfer body 2 to form the toner images of Black (K), Cyan (C), Magenta (M) and Yellow (Y) colors on the intermediate transfer body 2, a resist roll 8 to feed the paper P fed along the transfer route 6 to the transfer area at the predetermined timing, a paper guide plate 6 arranged along the transfer route 5, a transfer unit 10 to transfer the visible toner image transferred to the intermediate transfer body 2 to the paper P with the bias transfer roll 11, and a fixing unit 7 consisting of the fixing rolls 7A, 7B to fix the visible toner image transferred to the paper P. As the transfer unit 10, the structures of the profile of the first embodiment shown in FIG. 2, the profile of the second embodiment shown in FIG. 4, and the profile of the third embodiment shown in FIG. 5 can be applied.

According to this sixth embodiment, like the first embodiment, the speed variation of the intermediate transfer body 2 due to the impact generated when the paper P enters or leaves the nip area between the bias transfer roll 11 and intermediate transfer body 2 can be reduced.

Figure 9:
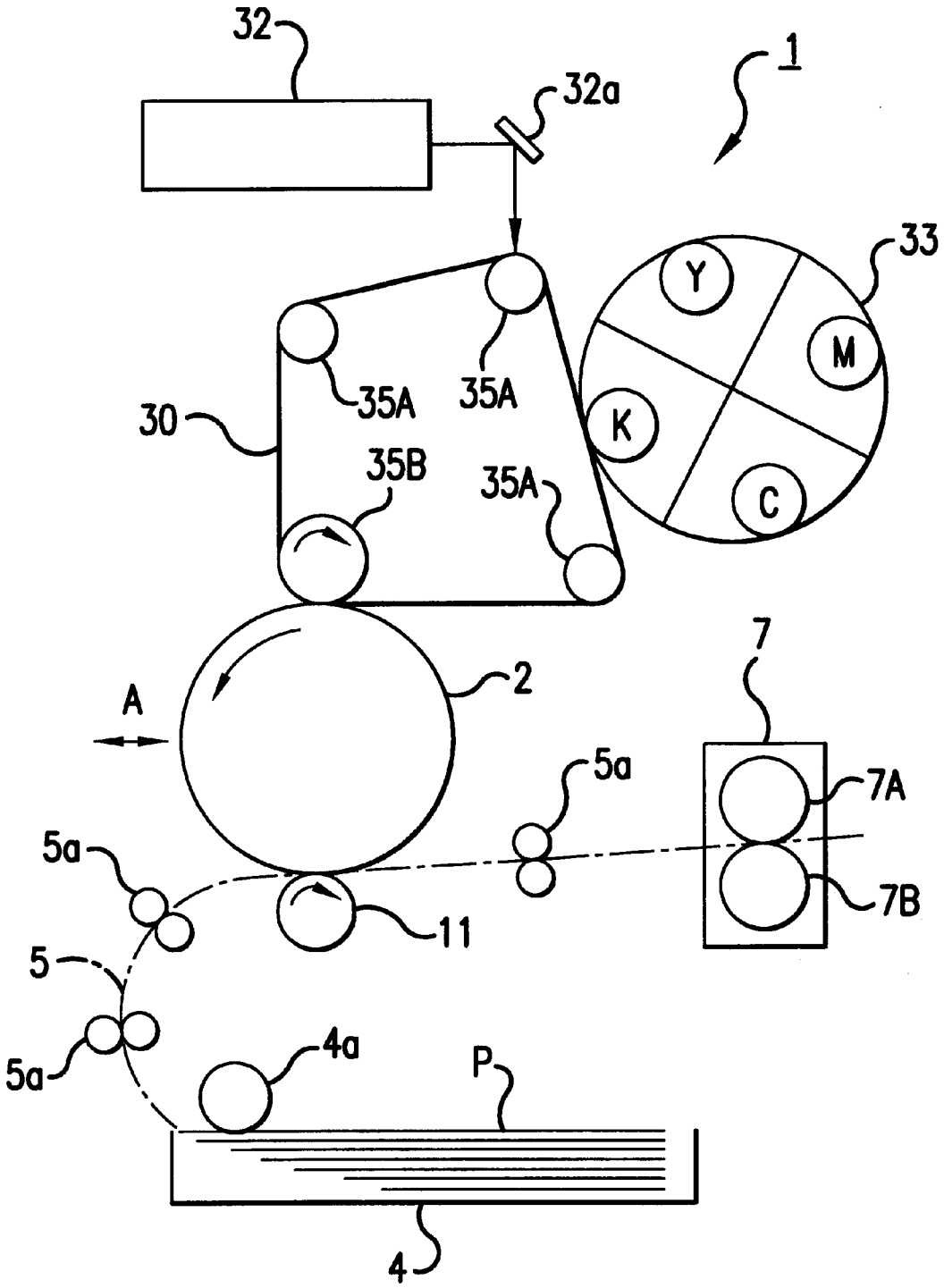
FIG. 9 is a schematic structural diagram of a copying machine in relation to the seventh embodiment of the present invent ion.

FIG. 9 shows a full-color copying machine to which the image forming apparatus in relation to the seventh embodiment of the present invention is applied. This copying machine 1 comprises a belt type photosensitive material 30 extended over a plurality of rolls 35A, 35B, an exposing unit 32 to form an electrostatic latent image by exposure through a reflection mirror 32*a* with the laser beam modulated based on the image signals of K, C, M, Y colors from the image processing section not illustrated, a rotary type developing unit 33 to develop the electrostatic latent image on the photosensitive material 30 to obtain a visible toner image by arranging the K, C, M, Y toners with the angular interval of 90 degrees and then rotating these toners at the time of development to supply the toner to the surface of the photosensitive material 30 corresponding to respective colors, a drum type intermediate transfer body 2 which swings in the right and left directions depending on the impact force generated when the photosensitive material 30 moves to transfer the visible toner image, a paper feed cassette 4 accommodating the paper P, a paper feed roll 4*a* to feed the paper P to the transfer route 5 from the paper feed cassette 4, a transfer roll 5*a* to transfer the paper P along the transfer route 5, a transfer unit 10 to transfer the color toner image transferred to the intermediate transfer body 2 to the paper P by means of the bias transfer roll 11, and a fixing unit consisting of the fixing rolls 7A, 7B for fixing the color toner image transferred to the paper P.

Figure 10:
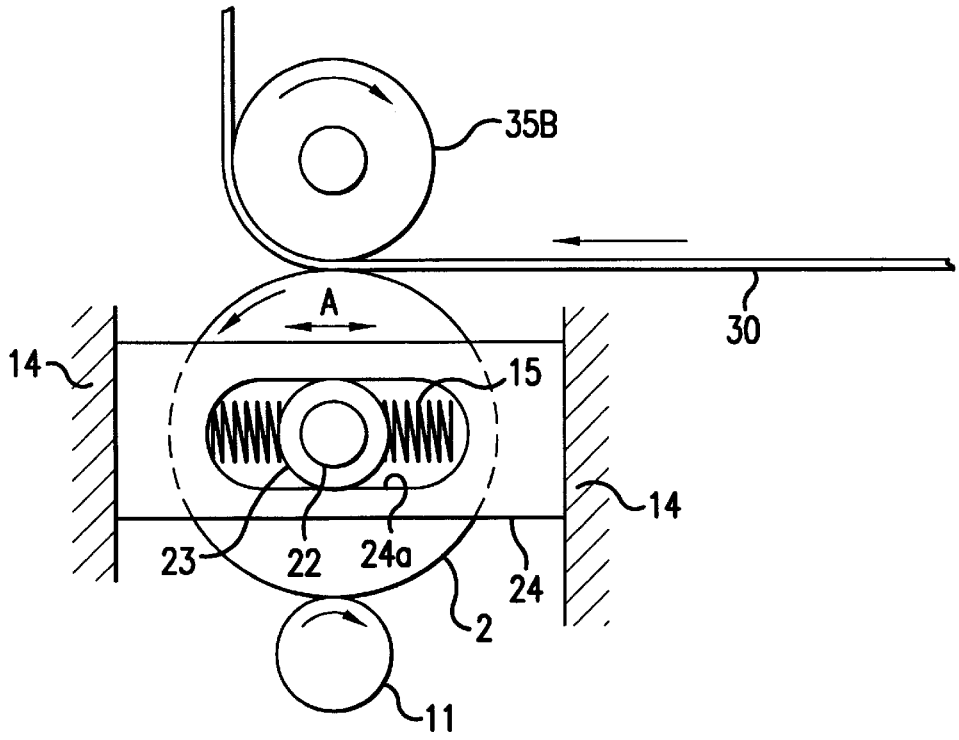
FIG. 10 is a diagram showing a swinging mechanism of the intermediate transfer body in relation to the seventh embodiment.

FIG. 10 shows a swinging mechanism of the intermediate transfer body 2 in relation to the seventh embodiment shown in FIG. 9. The intermediate transfer body 2 is brought in pressure contact with the photosensitive material 30 and a backup roll 35B is provided at the rear side of the photosensitive material 30 opposing to the intermediate transfer body 2. This swinging mechanism comprises a bearing 23 to support the rotating center shaft 22 of the intermediate transfer body 2, a supporting body 24 to support the bearing 23 to slide in the horizontal direction (A) within an elongated hole 24*a*, a couple of springs 15, 15 to support the bearing 23 from both sides to swing in the horizontal direction (A), and a fixing member 14 to fix the supporting body 24 from the body side of the copying machine 1.

According to this seventh embodiment, when the intermediate transfer body 2 receives an impact force when the transfer roll, transferring and fixing roll or cleaning unit are in contact with or separated from the intermediate transfer body 2, although not illustrated, this impact force is never transferred directly to the photosensitive material 30 and it can be absorbed when the intermediate transfer body 2 swings and thereby the speed variation of the photosensitive material 30 can be reduced.

Figure 11:
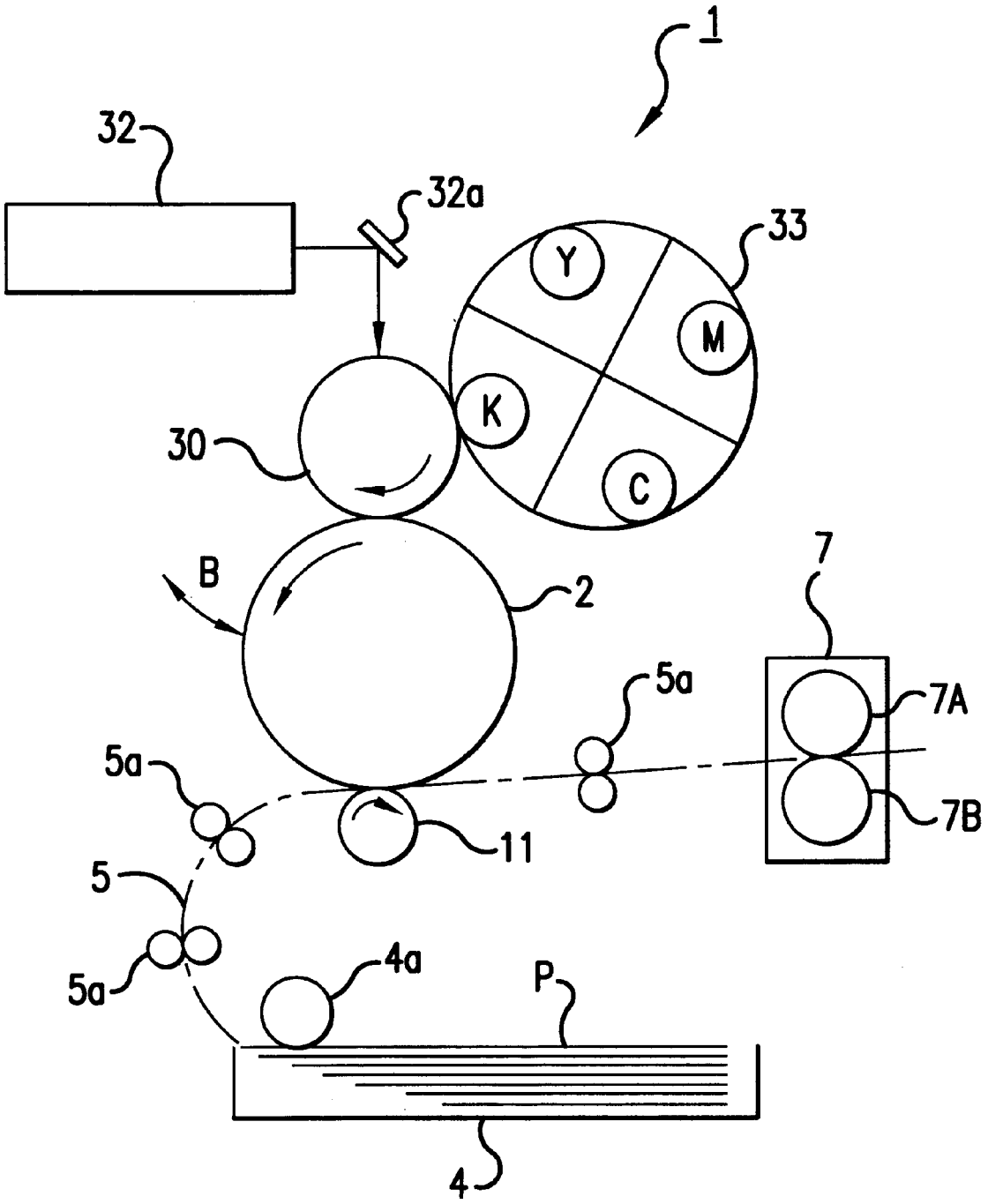
FIG. 11 is a schematic structural diagram of a copying machine in relation to the eighth embodiment of the present invention.

FIG. 11 shows a full-color copying machine to which the image forming apparatus in relation to the eighth embodiment of the present invention is applied. This copying machine 1 introduces a drum type photosensitive material 30 in the seventh embodiment. Thereby the intermediate transfer body 2 can swing in the arc direction B and the other portions are structured in the same manner as the seventh embodiment.

Figure 12:
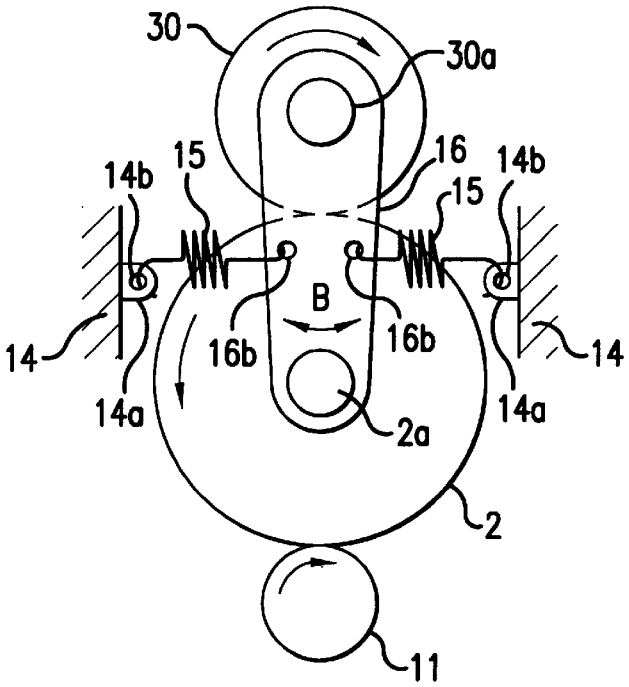
FIG. 12 is a diagram showing a swinging mechanism of the intermediate transfer body in relation to the eighth embodiment

FIG. 12 shows the swinging mechanism of the intermediate transfer body 2 in relation to the eighth embodiment shown in FIG. 11. In this swinging mechanism, the intermediate transfer mans 2 can swing around the rotating shaft 30*a* of the photosensitive material 30. Namely, this swinging mechanism comprises a supporting arm 16 of which the base end side is mounted to the rotating shaft 30*a* of the photosensitive material 30 to swing while the other end side rotatably supports the shaft 2*a* of the intermediate transfer body 2, a couple of fixing members 14, 14 formed to the body of the copying machine keeping the predetermined distance in the direction parallel to the traveling direction of the supporting body 12 and paper P, and a couple of spring 15, 15 to support the supporting arm 16 from both sides to swing around the rotating shaft 30*a* of the photosensitive material 30.

According to the profile of this eighth embodiment, since the intermediate transfer body 2 is supported to swing in such a direction that a contact pressure with the photosensitive material 30 is never changed (arc direction B), load variation between the photosensitive material 30 and intermediate transfer body 2 is not transferred via the contact point to prevent rotating fluctuation of the photosensitive material 30. Thereby, excellent image not including any defect of image quality can be obtained.

The present invention is not limited to the above embodiments explained above, allowing various changes of modifications without departing from the scope of the present invention. For example, in above embodiments, a photosensitive material is used as an image carrier but the present invention allows use of a drum type or belt type dielectric material.

Moreover, it is also possible to support the bias transfer roll 11 to swing only in the direction where the paper P enters.

In addition, in the third embodiment, it is also possible that the bias transfer roll 11 swings in the arc direction B around the rotating shaft of the intermediate transfer body 2.

Moreover, it is also possible, by applying the structure of the third embodiment to the intermediate transfer body, to control speed variation of an image carrier with a moving means to move the intermediate transfer body in the predetermined direction, detecting means to output a detecting signal by detecting an external force applied to the intermediate transfer body and a control means to control the moving means to displace the intermediate transfer body in such a direction as reducing an external force applied on the intermediate transfer body based on the detecting signal from the detecting means.

As explained above, the present invention supports the transfer member or intermediate transfer body to swing in the predetermined direction to swing them in the predetermined direction in accordance with an external force. Therefore, speed variation of the image carrier and intermediate transfer body can be controlled and as a result, excellent image not including any defect in the quality can be obtained.

What is claimed is:

1. An image transfer apparatus comprising:

a transfer member in pressure contact with an image forming medium at a predetermined contact pressure to transfer a visible image on said image forming medium to a recording medium traveling to a transfer area between said transfer member and said image forming medium, and movable means for supporting said transfer member to swing in a direction parallel or oblique to a direction in which the recording medium is traveling and causing said transfer member to swing in said direction depending on an external force generated on the basis of said recording medium traveling toward said transfer area.

2. The image transfer apparatus according to claim 1, wherein said movable means supports said transfer member to swing in a direction in which said recording medium is traveling.

3. The image transfer apparatus according to claim 1, wherein said movable means supports said transfer member to swing in a direction substantially parallel to a direction in which said recording medium is traveling.

4. The image transfer apparatus according to claim 1, wherein said movable means supports said transfer member to swing in such direction that said predetermined contact pressure does not change.

5. The image transfer apparatus according to claim 4, wherein said image forming medium is structured to rotate around a predetermined rotating shaft and said movable means is structured to support said transfer member to swing in an arc direction around said rotating shaft of said image forming medium.

6. The image transfer apparatus according to claim 1, wherein said movable means comprises moving means for moving said transfer member in said direction, detecting means for detecting said external force and to output a detecting signal and control means for controlling said moving means so that said transfer member displaces in the direction to reduce said external force dependent on said detecting signal from said detecting means.

7. The image transfer apparatus according to claim 1, wherein said movable means is provided with an elastic member to support said transfer member to swing in said predetermined direction.

8. The image transfer apparatus according to claim 1, wherein said transfer member is provided with an elastic member to press in contact with said image forming medium at said predetermined contact pressure.

9. The image transfer apparatus according to claim 1, wherein said transfer member is structured as a bias transfer member to transfer said visible image when a voltage of inverse polarity to said visible image is impressed.

10. The image transfer apparatus according to claim 1, wherein said transfer member is a simultaneous transferring and fixing member to simultaneously transfer and fix said visible image on said image forming medium to said recording medium.

11. An image transfer apparatus comprising:

an intermediate transfer body in pressure contact with an image carrier carrying an image at a surface thereof at a predetermined contact pressure while rotating at a predetermined speed, a contact member to transfer said visible image on said image carrier to said intermediate transfer body, and movable means for supporting said intermediate transfer body to swing in a direction and causing said intermediate transfer body to swing in said direction depending on an external force generated on the basis of contact of said contact member with said intermediate transfer body.

12. The image transfer apparatus according to claim 11, wherein said movable means is structured to swing said intermediate transfer body in a direction where said predetermined contact pressure does not change.

13. The image transfer apparatus according to claim 12, wherein said image carrier is structured to rotate around a predetermined rotating shaft and said movable means supports said intermediate transfer body to swing in an arc direction around said rotating shaft of said image carrier.

14. The image transfer apparatus according to claim 11, wherein said movable means comprises moving means to move said intermediate transfer body in said direction, detecting means to output a detecting signal by detecting said external force and control means for controlling said moving means causing said intermediate transfer body to displace in the direction to reduce said external force depending on said detecting signal from said detecting means.

15. The image transfer apparatus according to claim 11, wherein said movable means is structured to provide an elastic member to support said intermediate transfer body to swing in said predetermined direction.

16. The image transfer apparatus according to claim 11, wherein said intermediate transfer body is structured to provide an elastic member to be brought in pressure contact with said image carrier at said predetermined contact pressure.

17. The image transfer apparatus according to claim 11, wherein said intermediate transfer body is a bias transfer member to transfer said visible image when a voltage of inverse polarity to said visible image is impressed.

18. An image forming apparatus comprising:

an image forming medium and an intermediate transfer body forming a visible image on a surface of the intermediate transfer body while rotating at a predetermined speed;

a transfer member in pressure contact with said image forming medium at a predetermined contact pressure to transfer said visible image on said image forming medium to a recording medium traveling to a transfer area between the transfer member and said image forming medium; and movable means for supporting said transfer member to swing in a direction parallel or oblique to a direction in which the recording medium is traveling and causing said transfer member to swing in said direction depending on an external force generated on the basis of the traveling of said recording medium to said transfer area.

19. The image forming apparatus according to claim 18, wherein said movable means is structured to support said transfer member to swing in a traveling direction of said recording medium.

20. The image forming apparatus according to claim 18, wherein said movable means is structured to support said transfer member to swing in a direction substantially parallel to a traveling direction of said recording medium.

21. The image forming apparatus according to claim 18, wherein said movable means is structured to support said transfer member to swing in a direction where said predetermined contact pressure does not change.

22. The image forming apparatus according to claim 21, wherein said image forming medium is structured to rotate around a predetermined rotating shaft and said movable means is structured to swing said transfer member in an arc direction around said rotating shaft of said image forming medium.

23. The image forming apparatus according to claim 18, wherein said movable means comprises moving means to movie said transfer member in said direction, detecting means to detect said external force and output a detecting signal and control means to control said moving means to displace said transfer member in the direction to reduce said external force depending on said detecting signal from said detecting means.

24. The image forming apparatus according to claim 18, wherein said movable means is structured to provide an elastic member to support said transfer member to swing in said predetermined direction.

25. The image forming apparatus according to claim 18, wherein said transfer member is provided with an elastic member brought in pressure contact with said image forming medium at said predetermined contact pressure.

26. The image forming apparatus according to claim 18, wherein said transfer member is a bias transfer member to transfer said visible image when a voltage of inverse polarity to said visible image is impressed thereto.

27. The image forming apparatus according to claim 18, wherein said transfer member is a simultaneous transferring and fixing member to simultaneously transfer and fix said visible image on said image forming medium to said recording medium.

28. An image forming apparatus comprising:

an image carrier for carrying a visible image on a surface thereof while rotating at a predetermined speed;

an intermediate transfer body in pressure contact with said image carrier at a predetermined contact pressure; and movable means comprising a transfer member in contact with said intermediate transfer body and a contact member to support said intermediate transfer body to swing in a predetermined direction and to swing said intermediate transfer body in said predetermined direction depending on an external force generated on the basis of contact of said contact member with said intermediate transfer body.

29. The image forming apparatus according to claim 28, wherein said movable means is structured to rotate around a predetermined rotating shaft and said to support said intermediate transfer body to swing in an arc direction around said rotating shaft of said image carrier.

30. The image forming apparatus according to claim 29, wherein said image carrier is structured to rotate around an predetermined rotating shaft and said movable means is structured to support said intermediate transfer body to swing in an arc direction around said rotating shaft of said image carrier.

31. The image forming apparatus according to claim 28, wherein said movable means comprises moving means for moving said intermediate transfer body in said direction, detecting means for detecting said external force and to output a detecting signal and control means for controlling said moving means to displace said intermediate transfer body in the direction to reduce said external force depending on said detecting signal from said detecting means.

32. The image forming apparatus according to claim 28, wherein said movable means is structured to provide an elastic member to swing said intermediate transfer body in said predetermined direction.

33. The image forming apparatus according to claim 28, wherein said intermediate transfer body is provided with an elastic member to be brought in pressure contact with said image carrier at said predetermined contact pressure.

34. The image forming apparatus according to claim 28, wherein said intermediate transfer body is a bias member to transfer said visible image when a voltage of inverse polarity to said visible image is impressed thereto.

* * * * *